US010240602B2

(12) United States Patent
Able et al.

(10) Patent No.: US 10,240,602 B2
(45) Date of Patent: Mar. 26, 2019

(54) COMPRESSOR SYSTEM AND METHOD FOR CONDITIONING INLET AIR

(71) Applicant: Ingersoll-Rand Company, Davidson, NC (US)

(72) Inventors: Nicholas Able, Huntersville, NC (US); Michael Peters, Mooresville, NC (US); James Christopher Collins, Mooresville, NC (US); Srinivasa Rao Yenneti, Bangalore (IN); Kenneth J. Schultz, Onalaska, WI (US)

(73) Assignee: Ingersoll-Rand Company, Davidson, NC (US)

( * ) Notice: Subject to any disclaimer, the term of this patent is extended or adjusted under 35 U.S.C. 154(b) by 298 days.

(21) Appl. No.: 15/211,828

(22) Filed: Jul. 15, 2016

(65) Prior Publication Data

US 2018/0017061 A1 Jan. 18, 2018

(51) Int. Cl.
*F04C 29/04* (2006.01)
*F04C 29/00* (2006.01)
(Continued)

(52) U.S. Cl.
CPC ..... *F04C 29/0092* (2013.01); *F04C 18/16* (2013.01); *F04C 29/021* (2013.01);
(Continued)

(58) Field of Classification Search
CPC ..... F25B 1/00–1/10; F25B 2500/16; F25B 31/002; F25B 31/004; F25B 31/006;
(Continued)

(56) References Cited

U.S. PATENT DOCUMENTS 3,229,456 A 1/1966 Gratzmuller
3,680,283 A 8/1972 Jones, Jr.
(Continued)

FOREIGN PATENT DOCUMENTS

WO 2005055354 A1 6/2006
WO 2013172789 A1 11/2013
WO 2015114081 A1 8/2015

OTHER PUBLICATIONS

COMPAIR, Rotary Screw Compressors, Brochure, Re-Order Ref. 91005-096e (8 pages).

*Primary Examiner* — Peter J Bertheaud
*Assistant Examiner* — Dnyanesh Kasture
(74) *Attorney, Agent, or Firm* — Taft Stettinius & Hollister LLP

(57) ABSTRACT

The present disclosure provides a compressor system operable for compressing a working fluid such as air. A conditioner is positioned upstream of the compressor to reduce the humidity and may in certain forms control a temperature of the working fluid entering the compressor. An aftercooler and an oil cooler is positioned downstream of the compressor. A first heat exchange system may direct water from a source through the conditioner to the aftercooler and oil cooler. An oil heat exchange circuit directs oil from the compressor to the oil cooler and then to a regenerator prior to reentry into the compressor. A control system is operable for controlling portions of compressor system to provide inlet air to the compressor at a desired temperature and humidity.

27 Claims, 4 Drawing Sheets

(51) Int. Cl.
*F04C 18/16* (2006.01)
*F04C 29/02* (2006.01)

(52) U.S. Cl.
CPC ..... *F04C 29/026* (2013.01); *F04C 29/04* (2013.01); *F04C 2270/195* (2013.01)

(58) Field of Classification Search
CPC .... F04C 29/0092; F04C 29/04; F04C 29/021; F04C 18/16; F04C 29/026; F04C 2270/195
See application file for complete search history.

(56) References Cited

U.S. PATENT DOCUMENTS 4,220,197 A 9/1980 Schaefer et al.
4,311,439 A 1/1982 Stofen
4,936,109 A * 6/1990 Longardner ..... F04D 29/5826 62/238.3
5,087,178 A 2/1992 Wells
5,318,151 A 6/1994 Hood et al.
5,489,166 A * 2/1996 Schmit ..... B01J 8/003 34/360
5,697,763 A 12/1997 Kitchener
5,925,169 A 7/1999 Vertriest
6,494,053 B1 * 12/2002 Forkosh ..... B01D 53/263 62/271
6,688,857 B1 2/2004 Choroszylow et al.
6,807,821 B2 10/2004 Narney, II
6,895,774 B1 * 5/2005 Ares ..... B01D 53/265 62/332
8,347,629 B2 1/2013 Finkenrath et al.
8,424,337 B2 * 4/2013 Scarcella ..... F25B 31/002 62/470
8,955,323 B2 2/2015 Kamiya
2003/0166466 A1 9/2003 Hoke et al.
2004/0099140 A1 * 5/2004 Hesse ..... B01D 53/268 96/8
2004/0217180 A1 11/2004 Lu
2006/0153699 A1 7/2006 Gittoes
2006/0218938 A1 10/2006 Fornof
2008/0279708 A1 * 11/2008 Heimonen ..... F04C 29/0014 418/84
2009/0252632 A1 10/2009 Daniels et al.
2012/0037352 A1 * 2/2012 Osaka ..... B60H 1/00021 165/202
2012/0207621 A1 8/2012 Halttunen
2013/0156548 A1 * 6/2013 Takano ..... F04C 29/04 415/114
2014/0271258 A1 9/2014 Vezil et al.
2016/0186757 A1 6/2016 Collins

* cited by examiner

COMPRESSOR SYSTEM AND METHOD FOR CONDITIONING INLET AIR

TECHNICAL FIELD

The present application generally relates to industrial air compressor systems and more particularly, but not exclusively, improving compressor system efficiency by removing water and controlling a temperature of the air upstream of the compressor.

BACKGROUND

Industrial compressor systems are configured to produce large volumes of pressurized fluid such as air or the like. Efficiency improvements to compressor systems translate into cost savings for the system operator. Some existing systems have various shortcomings relative to certain applications. Accordingly, there remains a need for further contributions in this area of technology.

SUMMARY

One embodiment of the present disclosure is a unique compressor system with a control system operable to remove water and transfer heat from the air prior to being compressed in a compressor. Other embodiments include apparatuses, systems, devices, hardware, methods, and combinations for compressor systems with a unique method for increasing thermodynamic efficiency are disclosed herein. Further embodiments, forms, features, aspects, benefits, and advantages of the present application shall become apparent from the description and figures provided herewith.

DETAILED DESCRIPTION OF THE ILLUSTRATIVE EMBODIMENTS

Figure 1:
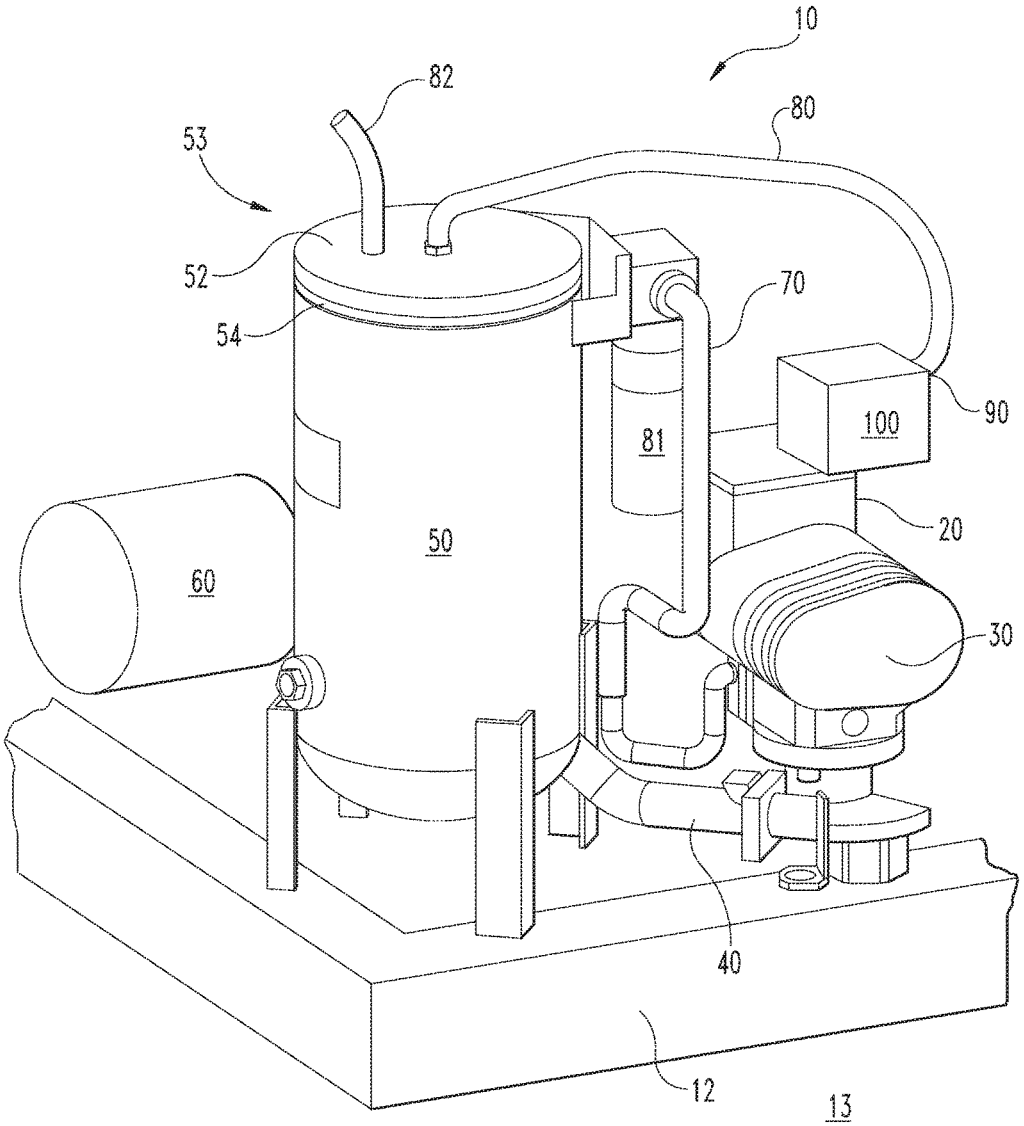
FIG. 1 is a perspective view of a compressor system according to one embodiment of the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Industrial compressor systems are configured to provide compressed fluids at a desired temperature, pressure and mass flow rate. Some compressor systems use fluid to fluid heat exchangers to control the temperature of compressed fluids at various stages within the system. The term "fluid" should be understood to include any gas or liquid medium used in the compressor system as disclosed herein. In some forms the present application can be directed to delivery of pressurized fluid with more than one fluid constituency such as a mixture of air and lubrication fluids including oil or the like. When the terms oil or lubricant are used herein it is intended to refer generally to a class of lubrication fluids that include petroleum based or synthetic formulations and can have a variety of properties and viscosities. When the term air is used it should be understood that other compressible working fluids can be substituted and not depart from the teachings or the present disclosure.

Referring now to FIG. 1, an exemplary compressor system 10 is shown in perspective view. The compressor system 10 includes a primary motive source 20 such as an electric motor, an internal combustion engine or a fluid-driven turbine and the like. The compressor system 10 can include a compressor 30 that may include single or multi-stage compression. The compressor 30 can be defined by oil flooded compressors such as a screw type however other types of oil flooded positive displacement compressors are contemplated herein. The primary motive source 20 is operable for driving the compressor 30 via a drive shaft (not shown) to compress gaseous fluids such as air and oil vapor or the like.

A structural base 12 is configured to support at least portions of the compressor system 10 on a support surface 13 such as a floor or ground. Portions of the compressed working fluid discharged from the compressor 30 can be transported through more one or more conduits 40 to a sump or separator tank 50 for separating fluid constituents such as air and oil or the like. One or more coolers 60 can be operably coupled with the system 10 for cooling working fluids to a desired temperature. The one or more coolers 60 can cool fluids such as compressed air, oil or other fluids to a desired temperature as defined by a control system. The control system can include a controller 100 operable for controlling the primary motive power source 20 and various valving and fluid control mechanisms (not shown) between the compressor 30 and intercoolers 60 such as, for example a blowdown valve 90.

The separator tank 50 can include a lid 52 positioned proximate a top portion 53 thereof. A seal 54 can be positioned between the lid 52 and separator tank 50 so as to provide a fluid tight connection between the lid 52 and the separator tank 50. Various mechanical means such as threaded fasteners (not shown) or the like can be utilized to secure the lid 52 to the separator tank 50. A blow down conduit 80 can extend from the separator tank 50 to the blow down valve 90. The blow down valve 90 is operable for reducing pressure in the separator tank 50 when the compressor 30 is unloaded and not supplying compressed air to an end load. In some configurations the blowdown conduit and associated valving may be omitted. An air supply conduit 82 can be operably coupled to the separator tank so as to deliver compressed air to a separate holding tank (not shown) or to an end load for industrial uses as would be known to those skilled in the art. An oil supply conduit 70 can extend from the separator tank 50 to the compressor 30 to supply oil that has been separated from the working fluid in the separator tank 50 to the compressor 30. One or more filters 81 can be used in certain embodiments to filter particles from the oil and/or separate contaminates such as water or the like from working fluids in the compressor system 10.

Figure 2:
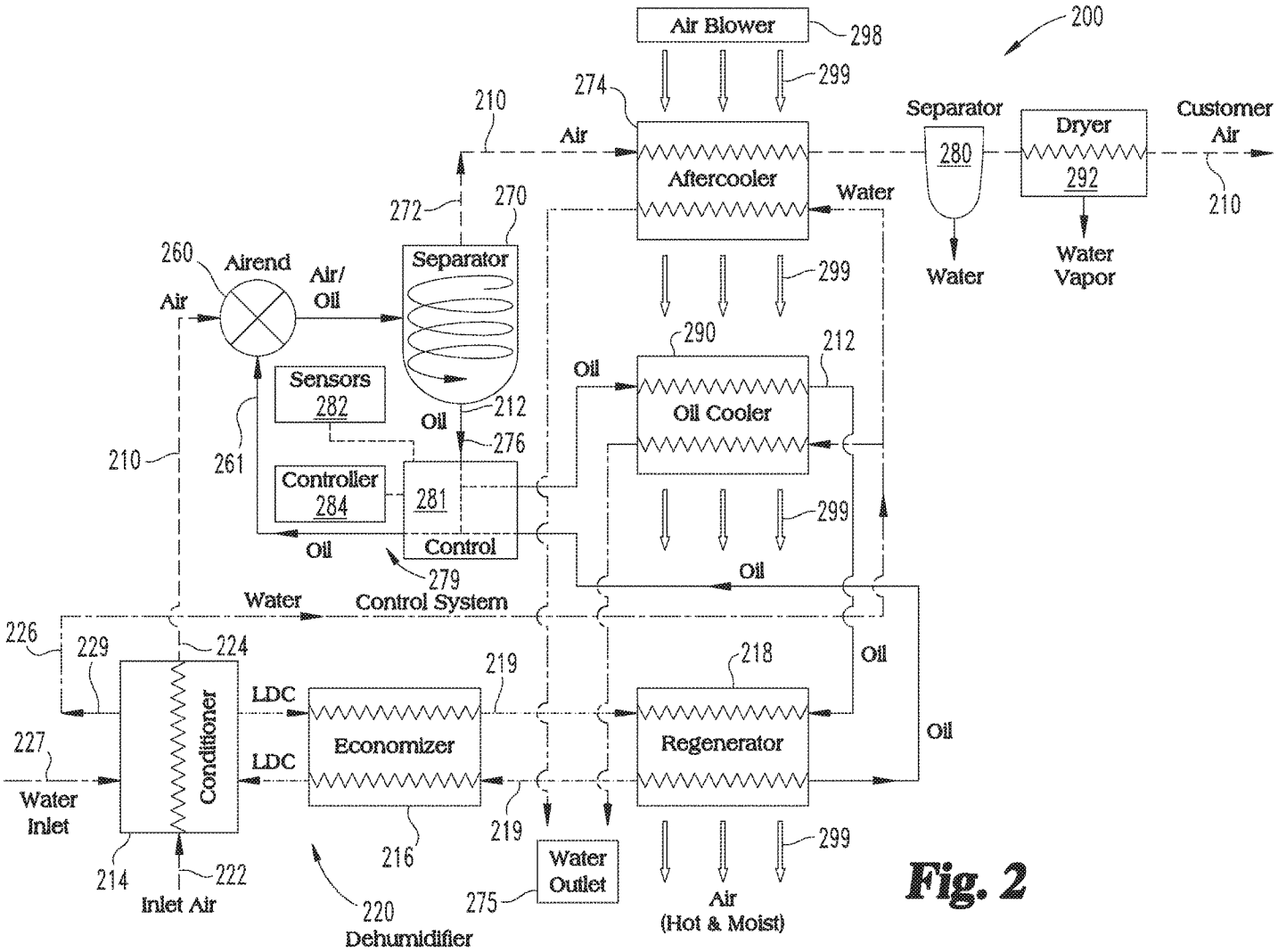
FIG. 2 is a schematic view of a fluid flow diagram according to one embodiment of the present disclosure.

Referring now to FIG. 2, an illustrative embodiment of an exemplary compressor system 200 is depicted therein. The compressor system 200 includes an air circuit 210 delineated by a dashed line and an oil circuit 212 delineated by a solid line to define a flow path for each fluid. The air circuit 210 begins with a source of ambient air that is delivered to a conditioner 214 of a dehumidifier 220 through an air inlet conduit 222. The dehumidifier 220 further includes an economizer 216 and a regenerator 218, each in fluid communication with conditioner 214. A liquid desiccant circuit (LDC) 219 passes in heat and mass transfer relationship with the conditioner 214, the economizer 216 and the regenerator 218. It should be noted that in some embodiments of the present disclosure the dehumidifier 220 will not include an economizer. The air is dried or de-moisturized in the dehumidifier 220 by removing at least a portion of the water vapor entrained therewith. A cooling circuit 226 defines a fluid flow path that traverses through the conditioner 214 and then through an oil cooler 290 and an aftercooler 274 prior to exiting through a water outlet or drain 275. In the illustrative embodiment the cooling circuit 226 can include water as a heat transfer medium. Other heat transfer mediums are contemplated such as by way of example and not limitation a glycol solution or a refrigerant. In some forms the cooling circuit 226 may be a closed loop system with a separate heat exchanger (not shown). In other forms the cooling circuit 226 may be an open loop system and include a drain or the like at the outlet 275. The cooling circuit 226 includes an inlet 227 to the conditioner 214 and an outlet 229 in fluid communication with downstream components. The conditioner 214 receives air through the air inlet 222, passes the air flow therethrough and exchanges heat with the cooling circuit 226 to cool and with the liquid desiccant to remove water content from the air upstream of the compressor 260. After the air is dried to a desired humidity level and cooled in the conditioner 214, the dehumidified air egresses through an air outlet conduit 224 operably coupled to the dehumidifier 220. The air is then directed to the compressor (airend) 260.

In the exemplary embodiment the compressor 260 is an oil flooded screw compressor wherein oil is injected into the compressor 260 to provide temperature control of the compressor discharge fluid. After compression, the mixture of air and oil is directed to a separator tank 270 whereby air and oil are separated in a manner that is known by those skilled in the art. An air outlet conduit 272 directs the relatively pure air to the aftercooler 274. In some embodiments a water separator 280 operable for removing water particles from the air and a dryer 292 operable for removing water vapor from the air can be positioned downstream of the aftercooler 274. After exiting the dryer 292, the compressed air is delivered to a storage tank (not shown) or an end use machine (also not shown) and the like.

After the oil is separated from the air in the air-oil separator tank 270, the oil is removed through an oil outlet conduit 276 operably connected to the air-oil separator tank 270. The oil is heated from the compression process in the compressor 260 and may be cooled in some instances in an oil cooler 290. The oil flows through the oil circuit 212 from the separator tank to a control system 279. The control system 279 can include one or more control valves 281, one or more sensors 282 and an electronic controller including a microprocessor with a programmable memory. The control valve 281 can be operably connected to the one or more sensors 282 and the electronic controller 284 so as to provide for an active real-time control system. The sensors 282 can include but are not limited to pressure, temperatures, mass flow, speed sensors, hygrometers, and relative humidity (RH) sensors positioned in various locations throughout the compressor system 200 as one skilled in the art would readily understand. In some embodiments separate pumps (not shown) can be positioned in the oil circuit to move the oil from one location to another, however, in other embodiments the pressurized fluid discharged from compressor 260 can cause the oil to flow at a velocity required to provide a desired oil flow rate.

The relatively hot oil can be used to regenerate the dehumidifier in certain embodiments such as those using desiccate-type dehumidifier configuration. The heated oil can help to dry out or regenerate the desiccate that has absorbed water from the air as the air flows through the dehumidifier 220. The oil can be cooled in the oil cooler 290 prior to flowing through the regenerator 218, however, the temperature of the oil is still at an elevated temperature at this point in the flow circuit 212 and therefore capable of regenerating the dehumidifier 220. The regeneration occurs when oil is directed through the regenerator 218 in the oil circuit 212. After exiting from the regenerator 218, the oil is directed back to one or more of the control valves 281 wherein the cooled oil mixes with uncooled oil and is then delivered back to the compressor 260 through an oil inlet at a desired temperature.

In one form an air mover such as a blower or fan 298 can be used to blow (or draw) air from an ambient source represented by arrows 299 through the aftercooler 274, the oil cooler 290 and regenerator 218 to cool the compressed air, the oil and portions of the regenerator 218, respectively. In the illustrated embodiment the air blower 298 delivers cooling air to the aftercooler 298, the oil cooler 290 and the regenerator 218 in series. In other forms the flow 299 to each of the cooled systems may be delivered in parallel and/or additional blowers may be used. In still other forms the flow 299 may be shut off or diverted from one or more of the aftercooler 298, oil cooler 290 and regenerator 298 in certain embodiments.

In operation the controller 284 along with the one or more control valves 281 and the sensors 282 are operable for controlling the temperature of the oil injected into the compressor 260. In some embodiments it is desirable that the temperature of the discharged compressed fluid is at or above a pressure dew point temperature at a particular compressor operating point so that liquid water is not precipitated out of the working fluid mixture of air and oil. The desired temperature can be the pressure dew point temperature at the particular operating condition plus a temperature margin for a safety factor that may include an increase in the target temperature from 1° F. to as many as 20° F. or higher to insure that the discharge temperature remains above the dew point temperature downstream of the compressor 260.

Figure 3:
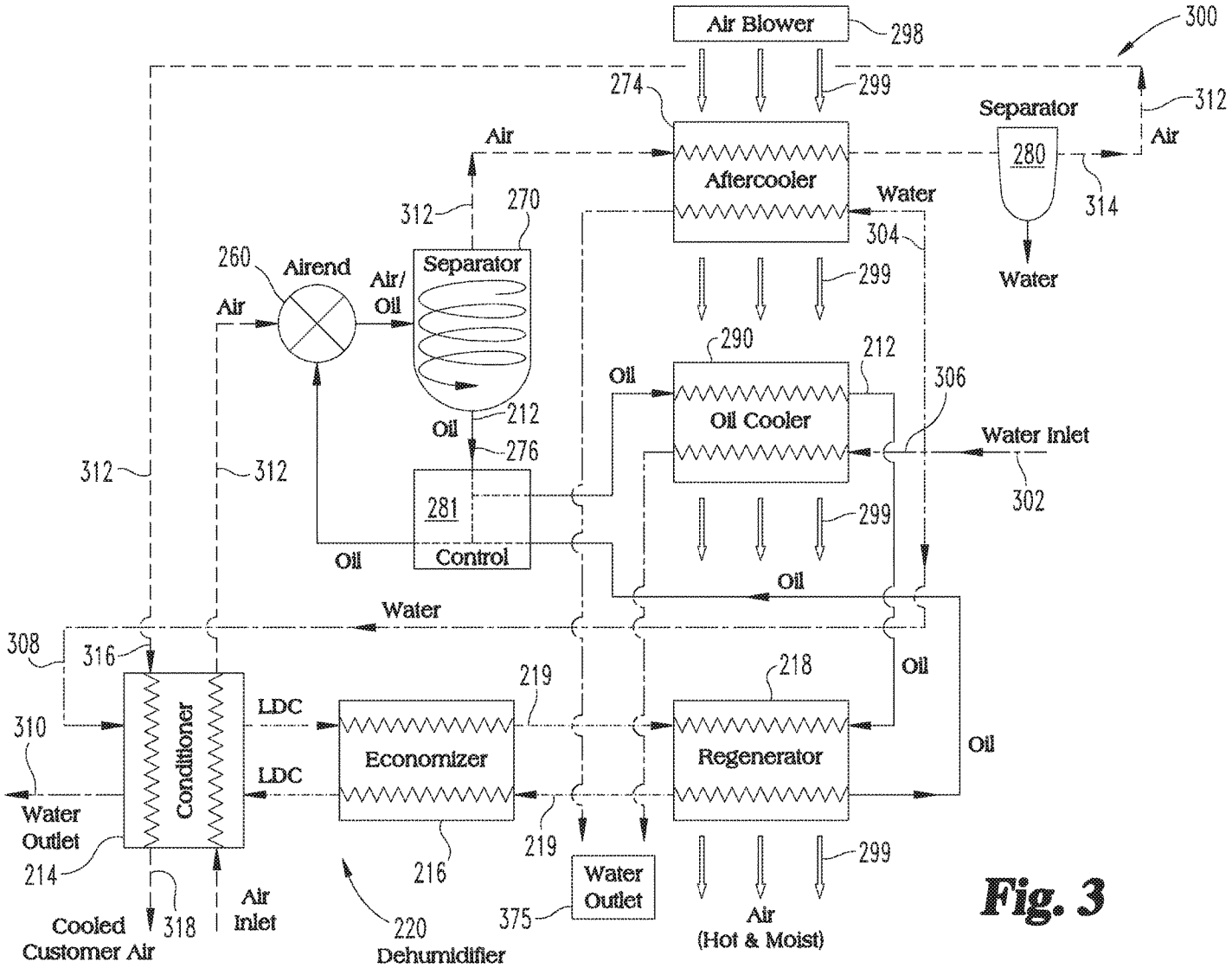
FIG. 3 is a schematic view of a fluid flow diagram according to another embodiment of the present disclosure.

Referring now to FIG. 3, another embodiment of a compressor system 300 is disclosed. The embodiment illustrated in FIG. 3 is similar to the embodiment illustrated in FIG. 2 in certain aspects as illustrated with components having the same callout numbers and will not be described again. In this configuration a main water inlet 302 is in fluid communication with an aftercooler inlet 304, an oil cooler inlet 306 and a conditioner inlet 308. Each of the component water inlets 304, 306, and 308 are fed from the main water inlet 302 in parallel. In some forms, the water exiting the aftercooler 274 and the oil cooler 290 is directed to a water drain 375 and the water exiting the conditioner 214 exits through a water outlet 310. In other forms not shown, the water outlet 310 may be in fluid communication with the water drain 375 such that each of the water passageways converges together at the water drain 375.

In this form, an air circuit 312 follows a similar path to that of FIG. 2. However when the air circuit 312 exits the water separator 280 through a water separator outlet 314, the air circuit 312 passageway loops back through a second air inlet 316 coupled to the conditioner 214. The compressed air is further dried to remove at least a portion of any remaining water vapor entrained with the compressed air stream and to cool the compressed air to a temperature required for customer end use at the outlet 318.

Figure 4:
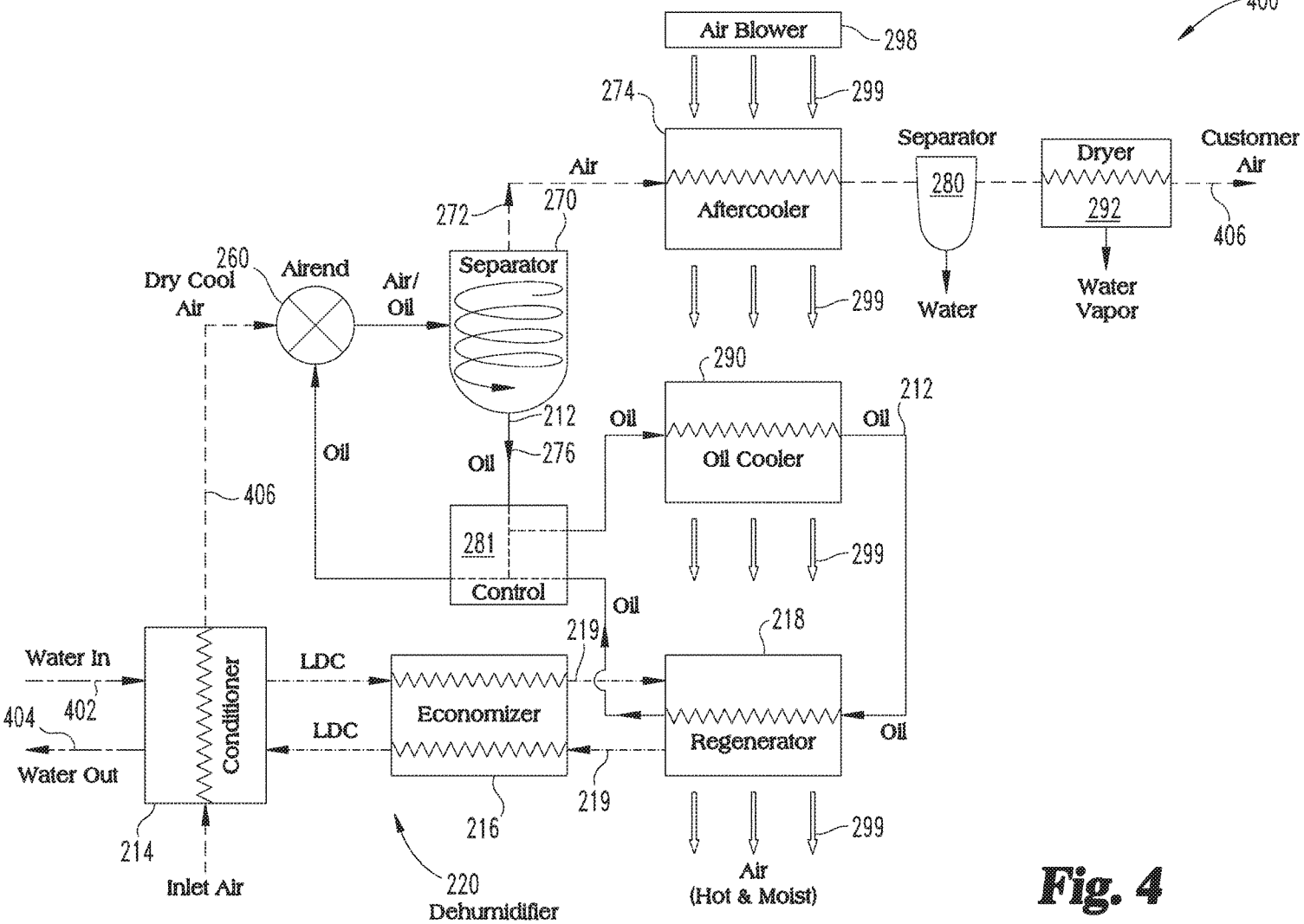
FIG. 4 is a schematic view of a fluid flow diagram according to another embodiment of the present disclosure.

Referring now to FIG. 4, another embodiment of a compressor system 400 is disclosed. The embodiment illustrated in FIG. 4 is similar to the embodiment illustrated in FIG. 2 in certain aspects as defined with those components with the same callout numbers and will not be described again. In this configuration a main water inlet 402 is in fluid communication with the conditioner 214 and the water circuit exits the conditioner 214 through a water outlet 404 and is not directed to another component. While the air circuit 406 depicted herein is similar to the air circuit shown in FIG. 2, it should be understood that the air circuit 406 may loop back through the conditioner downstream of the dryer 292 to further cool and dry the compressed air as illustrated in the embodiment depicted in FIG. 3.

In one aspect, the present disclosure includes a compressor system comprising a fluid compressor operable for compressing a compressible fluid including a mixture of air; a lubrication supply system operable for supplying oil to the compressor; a dehumidifier operable for removing moisture from a compressible working fluid upstream of the fluid compressor, the dehumidifier including a conditioner and a regenerator; an optional economizer may be associated with the dehumidifier in certain embodiments; an oil cooler configured to cool oil downstream of the fluid compressor; an aftercooler configured to cool compressed air downstream of the fluid compressor; and a cooling circuit having a cooling fluid passing through the conditioner, the oil cooler and the aftercooler.

In refining aspects, the present disclosure includes a cooling circuit with water as a heat transfer medium; wherein the cooling fluid in the cooling circuit exits the conditioner and enters the oil cooler and aftercooler in parallel; wherein the cooling fluid in the cooling circuit enters the conditioner, the oil cooler and the aftercooler in parallel from a water inlet conduit; a dehumidifier heat exchange fluid circuit defined through the conditioner, the economizer and the regenerator; wherein dehumidifier heat exchange fluid circuit includes a liquid desiccant solution; an air mover or blower; wherein the blower directs air through the aftercooler, oil cooler and regenerator; a water separator configured to remove water from the compressed air downstream of the compressor; a dryer configured to remove water vapor from the compressed air downstream of the water separator; wherein the compressed air is directed through the conditioner after exiting from the water separator; wherein inlet air is directed through the conditioner prior to entering the fluid compressor.

In another aspect, the present disclosure includes a compressor system comprising a fluid compressor operable for compressing a working fluid with a mixture of oil; a dehumidifier operable for removing moisture from the compressible working fluid upstream of the fluid compressor, the dehumidifier including a conditioner and a regenerator; an optional economizer may be associated with the dehumidifier in certain embodiments; an oil cooler configured to cool oil downstream of the fluid compressor; an aftercooler configured to cool compressed air downstream of the fluid compressor; and at least one air mover or blower in fluid communication with the aftercooler, the oil cooler and the regenerator.

In refining aspects, the present disclosure includes a cooling circuit having a cooling fluid passing through the conditioner; wherein the cooling circuit includes water; a lubrication supply system operable for supplying oil to the compressor; wherein the lubrication supply system includes an air-oil separator in upstream fluid communication with the aftercooler, the oil cooler and the regenerator; a closed loop dehumidifier heat exchange fluid circuit defined between the conditioner, the economizer and the regenerator; a water separator configured to remove water from the compressed air downstream of the compressor; a dryer configured to remove water vapor from the compressed air downstream of the water separator; wherein the compressed air is directed through the conditioner after exiting from the water separator to further cool and/or remove water vapor from the compressed air.

In another aspect the present disclosure includes a method comprising cooling and dehumidifying inlet air with a conditioner in a dehumidifier; compressing the inlet air with a compressor downstream of the dehumidifier; cooling compressed air in an aftercooler downstream of the compressor; cooling oil with an oil cooler downstream of the compressor; and wherein the cooling and dehumidifying of the inlet air includes passing water through a cooling circuit in the conditioner.

In refining aspects the present disclosure includes a method for cooling the air and cooling the oil which includes extending the cooling circuit through the aftercooler and the oil cooler, respectively; wherein the water passes through the aftercooler and the oil cooler in parallel downstream of the conditioner; wherein the water passes through the aftercooler, the oil cooler and the conditioner in parallel downstream of a water inlet line; wherein the cooling of the aftercooler and the oil cooler includes blowing air through a passageway in each, respectively; a liquid desiccant heat exchange circuit formed through the conditioner, an economizer and a regenerator; exchanging heat between a relatively higher temperature path and a relatively lower temperature path of a liquid desiccant heat exchange circuit in the economizer; and an oil heat exchange circuit passing through the oil cooler and the regenerator configured to be in fluid communication with the cooling circuit and the liquid desiccant heat exchange circuit, respectively.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A compressor system comprising:

a fluid compressor operable for compressing a compressible fluid including a mixture of air and oil;

a lubrication supply system operable for supplying oil to the compressor;

a dehumidifier operable for removing moisture from a compressible working fluid upstream of the fluid compressor, the dehumidifier including a conditioner and a regenerator;

an oil cooler configured to cool oil downstream of the fluid compressor;

an aftercooler configured to cool compressed air downstream of the fluid compressor; and a cooling circuit having a cooling fluid passing through the conditioner, the oil cooler and the aftercooler, the cooling circuit being of the open-loop type in which a cooling fluid originating from a source passes through each of the conditioner, oil cooler, and aftercooler before being exhausted from the cooling circuit.

2. The compressor system of claim 1, wherein the cooling circuit includes water.

3. The compressor system of claim 1, wherein the cooling fluid in the cooling circuit exits the conditioner and enters the oil cooler and aftercooler in parallel.

4. The compressor system of claim 1, wherein the cooling fluid in the cooling circuit enters the conditioner, the oil cooler and the aftercooler in parallel from a water inlet conduit.

5. The compressor system of claim 1 further comprising a dehumidifier heat exchange fluid circuit defined through the conditioner, an economizer and the regenerator.

6. The compressor system of claim 5, wherein dehumidifier heat exchange fluid circuit includes a liquid desiccant solution.

7. The compressor system of claim 1, further comprising an air mover.

8. The compressor system of claim 7, wherein the air mover directs air through the aftercooler, oil cooler and regenerator.

9. The compressor system of claim 1, further comprising a water separator configured to remove water from the compressed air downstream of the compressor.

10. The compressor system of claim 9, further comprising a dryer configured to remove water vapor from the compressed air downstream of the water separator.

11. The compressor system of claim 9, wherein the compressed air is directed through the conditioner after exiting from the water separator.

12. The compressor system of claim 1, wherein inlet air is directed through the conditioner prior to entering the fluid compressor.

13. The compressor system of claim 1 further comprising a closed loop dehumidifier heat exchange fluid circuit defined between the conditioner, an economizer and the regenerator.

14. The compressor system of claim 1, further comprising a water separator configured to remove water from the compressed air downstream of the compressor.

15. The compressor system of claim 14, further comprising a dryer configured to remove water vapor from the compressed air downstream of the water separator.

16. The compressor system of claim 14, wherein the compressed air is directed through the conditioner after exiting from the water separator to further cool and/or remove water vapor from the compressed air.

17. A compressor system comprising:

a fluid compressor operable for compressing a mixture of working fluid and oil;

a dehumidifier operable for removing moisture from the compressible working fluid upstream of the fluid compressor, the dehumidifier including a conditioner and a regenerator;

an oil cooler configured to cool oil downstream of the fluid compressor;

an aftercooler configured to cool compressed air downstream of the fluid compressor;

at least one air mover in fluid communication with the aftercooler, the oil cooler and the regenerator; and an open-loop cooling circuit having a cooling fluid pathway routed to pass through the conditioner, oil cooler, and aftercooler.

18. The compressor system of claim 17, wherein the cooling circuit includes water.

19. The compressor system of claim 17 further comprising a lubrication supply system operable for supplying oil to the compressor.

20. The compressor system of claim 19, wherein the lubrication supply system includes an air-oil separator in upstream fluid communication with the aftercooler, the oil cooler and the regenerator.

21. A method comprising:

cooling and dehumidifying inlet air with a conditioner in a dehumidifier;

compressing the inlet air with a compressor downstream of the dehumidifier;

cooling compressed air in an aftercooler downstream of the compressor;

cooling oil with an oil cooler downstream of the compressor; and wherein the cooling and dehumidifying of the inlet air includes passing water through an open-loop cooling circuit which includes the conditioner of the dehumidifier, the open-loop cooling circuit in further fluid communication with the aftercooler and the oil cooler.

22. The method of claim 21, wherein the water passes through the aftercooler and the oil cooler in parallel downstream of the conditioner.

23. The method of claim 21, wherein the water passes through the aftercooler, the oil cooler and the conditioner in parallel downstream of a water inlet line.

24. The method of claim 21, wherein the cooling of the aftercooler and the oil cooler includes blowing air through a passageway in each, respectively.

25. The method of claim 21, further comprising a liquid desiccant heat exchange circuit formed through the conditioner, an economizer and a regenerator.

26. The method of claim 25, further comprising exchanging heat between a relatively higher temperature path and a relatively lower temperature path of a liquid desiccant heat exchange circuit in the economizer.

27. The method of claim 25, further comprising an oil heat exchange circuit passing through the oil cooler and the regenerator configured to be in fluid communication with the cooling circuit and the liquid desiccant heat exchange circuit, respectively.

* * * * *